United States Patent [19]

Inagaki

[11] Patent Number: 4,596,920

[45] Date of Patent: Jun. 24, 1986

[54] HEAT ROLLER FIXING DEVICE

[75] Inventor: Sanji Inagaki, Toyokawa, Japan

[73] Assignee: Minolta Camera Kabushiki Kaisha, Osaka, Japan

[21] Appl. No.: 727,392

[22] Filed: Apr. 24, 1985

Related U.S. Application Data

[62] Division of Ser. No. 545,492, Oct. 26, 1983, Pat. No. 4,550,243.

[30] Foreign Application Priority Data

Nov. 4, 1982 [JP] Japan ..... 57-194218

[51] Int. Cl.[4] ..... G03G 15/20

[52] U.S. Cl. ..... 219/216; 219/469; 355/3 FU

[58] Field of Search ..... 219/216, 469, 470, 471; 355/3 FU, 14 FU; 432/60, 228; 29/611; 427/372.2, 385.5, 388.1

[56] References Cited

U.S. PATENT DOCUMENTS

| | | | |
|---|---|---|---|
| 3,235,772 | 2/1966 | Gurin | 219/216 |
| 4,179,601 | 12/1979 | Tarumi et al. | 219/216 |
| 4,257,699 | 3/1981 | Lentz | 355/3 FU |
| 4,272,179 | 6/1981 | Seanor | 355/3 FU |
| 4,320,714 | 3/1982 | Shimazaki | 432/60 |
| 4,372,246 | 2/1983 | Azar | 219/216 |
| 4,434,355 | 2/1984 | Inagaki | 219/469 |

OTHER PUBLICATIONS

Evans, H. E. and A. A. Parker, "Hot Roll Fuser", IBM Tech. Disc. Bull., vol. 25, No. 7B, Dec. 1982, p. 3985.

*Primary Examiner*—Clarence L. Albritton
*Assistant Examiner*—Teresa J. Walberg
*Attorney, Agent, or Firm*—Wenderoth, Lind & Ponack

[57] ABSTRACT

A heat roller fixing device for use in an electrophotographic copying apparatus and the like, which includes a heating roller constituted by a fluorine resin layer laminated on an electrically conductive core member through a primer layer the heated roller being driven for rotation, and a pressure roller constituted by an electrically insulative layer on another electrically conductive core member and held in contact with the heating roller for simultaneous rotation with the heating roller so as to fix a charged toner image formed on copy paper onto the copy paper by causing the copy paper carrying the toner image thereon to pass between the heating roller and pressure roller. The primer layer is composed of a primer having incorporated therein an electrically conductive material, and the primer of the primer layer is partly exposed at the surface of the fluorine resin layer. Triboelectric charges produced on the surface of the fluorine resin layer are released by grounding through the primer layer and the electrically conductive core member.

8 Claims, 20 Drawing Figures

| Example | Carbon black add amount in primer (part by wt.) | Thickness of layer (μ) 1st layer (primer) | 2nd layer (PFA resin) | 4th layer (PFA resin) | Offset property with respect to positively charged toner in check point paper pass. time 2-5 min. Fixing temp. (°C) 130 170 210 | Offset property with respect to negatively charged toner in check point paper pass. time 60 min. Fixing temp. (°C) 130 170 210 |
|---|---|---|---|---|---|---|
| Comparative Example | 0 | 6 | 30~40 | — | | |
| Example 1 | 1.0 | 5 | 15 | 15 | | |
| Example 2 | 0.5 | 5 | 15 | 15 | | |
| | 1.5 | 5 | 15 | 15 | | |
| | 2.0 | 5 | 15 | 15 | | |
| Example 3 | 1.0 | 5 | 5 | — | | |
| | 1.0 | 5 | 15 | — | | |
| | 1.0 | 5 | 30 | — | | |
| Example 4 | 1.0 | 5 | 15 | 23 | | |
| | 1.0 | 5 | 15 | 30 | | |
| Example 5 | 1.5 | 15 | 35 | — | | |

FIG.20

HEAT ROLLER FIXING DEVICE

This application is a division of U.S. Ser. No. 545,492, filed Oct. 26, 1983, now U.S. Pat. No. 4,550,243.

BACKGROUND OF THE INVENTION

The present invention relates to a heat roller fixing device, and more particularly to a heat roller fixing device which, as shown in FIG. 1, comprises a heating roller 5 incorporating a heater 4 and having a fluorine resin layer 3 over an electrically conductive core member 1 with a primer layer 2 interposed therebetween, and a pressure roller 8 having an insulating layer 7 over an electrically conductive core member 6 and adapted for pressing contact with the heating roller 5. When the fixing device is in operation, the heating roller 5 is heated by the heater 4 at a suitable temperature of 140° to 180° C. in accordance with the kind of toner used. Copy paper P having a charged toner image 9 formed thereon is passed between the rollers 5 and 8 with the image bearing surface facing the heating roller 5, whereby the toner image 9 is fixed onto the copy paper P. The drawing further shows a guide plate 10, a discharge roller 11, a separating pawl 12 and a thermistor 13.

With heat roller fixing devices of this type, the surface of the heating roller has good release properties sufficient to prevent thermal adhesion of the toner without necessitating application of silicone oil or like offset preventing agent, or with use of only a very small amount of such agent. The device therefore renders the copy paper free from stains and gives prints which feel good to the touch. However, the fluorine resin surface layer 3 of the heating roller 5, which is triboelectrically charged by the insulating surface layer 7 of the pressure roller 8 or by the copy paper P, is liable to electrostatically attract toner images and to permit offset, whereby: the offset preventing agent is unable to preclude the offset due to triboelectrification.

The present inventor, together with other inventors, has already provided a heat roller fixing device wherein the primer layer 2 of the heating roller 5 is formed of a fluorine resin containing carbon black and which is adapted to prevent the offset due to such triboelectrification (U.S. patent application Ser. No. 351,930 filed on Feb. 24, 1982). This device solved a problem conventionally experienced. With the known device shown in FIG. 1, the triboelectric charges on the heating roller 5, which were of negative polarity when the assembly started passage of paper, reached a maximum of more than -600 V upon lapse of about 5 minutes, Then reversed to positive polarity upon lapse of about 10 minutes and thereafter reached about +200 V max. as illustrated in FIG. 9 by hatching, whereas negative charging is almost avoidable with the device of U.S. Ser. No. 351,930. Accordingly the heating roller 5, is readily held at positive; polarity to inhibit the electrostatic attraction of toner to the roller 5 and prevent offset when the toner is charged positively.

Nevertheless, since it is nearly impossible to eliminate the positive charges, offset is unavoidable when a toner of negative polarity is used, so that the device is limited in the polarity of the toner to be used, since the charges could produce an adverse effect.

SUMMARY OF THE INVENTION

An object of the present invention is to provide a heat roller fixing a device wherein negative and positive triboelectrification of the heating roller is inhibited to prevent the offset of either positively charged toner or negatively charged toner.

The present inventor has found that the above object can be fulfilled by making use of the electrical conductivity of the aforementioned carbon black-containing primer layer, i.e., by partly exposing the primer layer at the surface of the fluorine resin layer to release triboelectric charges by grounding through the primer layer and the electrically conductive core member.

More specifically, the present invention provides a heat roller fixing device of the type shown in FIG. 1 wherein a primer having incorporated therein an electrically conductive material is used for the primer layer of the heating roller, the fixing device being characterized in that the heating roller comprises at least one primer layer and at least one fluorine resin layer formed over the primer layer to provide the surface of the heating roller, the primer layer being partly exposed at the surface of the fluorine resin layer.

Because of this structure, the surface of the heating roller has improved strength, is less susceptible to defacement due to contact with the separating pawl or thermistor, possesses high durability, is low in potential when triboelectrically charged positively or negativelly, and will not produce an adverse effect on other members or other process.

BRIEF DESCRIPTION OF THE DRAWINGS

FIG. 2 shows the step of coating an electrically conductive core member with a primer;

FIG. 3 shows the step of electrostatically coating the resulting primer coating with a finely divided fluorine resin;

FIG. 4 shows the step of forming a second primer coating;

FIG. 5 shows the step of forming a second finely divided fluorine resin coating electrostatically;

FIG. 6 shows the step of baking the resulting overall coating in an oven;

FIG. 7 shows a grinding step for exposing all penetrating portions of the primer at the outer peripheral surface of the roller;

FIG. 20 is a diagram showing the offset properties of the heating rollers of the comparative example and the examples of the present invention as determined during the period of 2 to 5 minutes after the start of passage of copy paper and also as determined 60 minutes after the start of passage of paper.

DETAILED DESCRIPTION OF THE INVENTION

Figure 1:
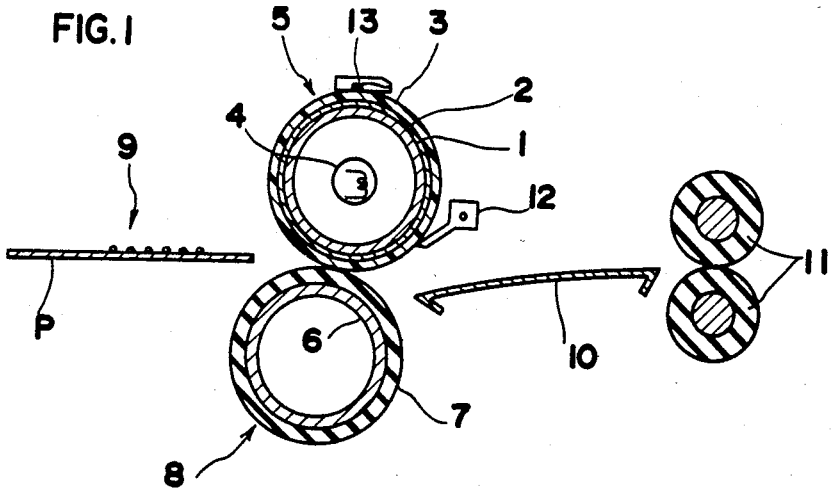
FIG. 1 is a side elevation in section showing a conventional heat roller fixing device which is generally used and to which the present invention is applied.

The present invention provides a heat roller fixing device of the type shown in FIG. 1 wherein a primer having incorporated therein an electrically conductive material is used for the primer layer 2 of the heating roller 5. The device is characterized in that the heating roller 5 comprises at least one primer layer 2 and at least one fluorine resin layer 3 which is formed over the primer layer 2 to provide the surface of the heating roller 5, and in that the primer layer 2 is partly exposed at the surface of the fluorine resin layer 3.

Examples of materials useful for the electrically conductive core member are aluminum, aluminum alloy, iron alloys such as stainless steel, and other metals.

For the fluorine resin layer, it is preferable to employ fluorine resins superior in heat resistance, such as polytetrafluoro ethylene resin (PTFE) represented by the formula

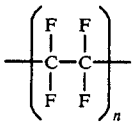

polytetrafluoro ethylene perfluoro alkoxy ethylene copolymer resin (PFA resin) represented by the formula

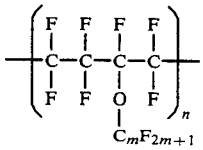

and the like.

The primer layer of the heating roller is formed from a primer of the solution type composed chiefly of fluorine resin which is commercially available as an adhesive priming agent for iron alloys, aluminum alloys and like metal materials mentioned. Examples of useful primers ar COOKWEAR A PRIMER WHITE 459-882 (brand name, product of Du Pont Co., Ltd. Japan), MP902BN (brand name, product of Mitsui Phlorochemical Co., Japan), etc. Useful as the electrically conductive material to be incorporated into the primer is a metallic powder, or carbon black which may be any of furnace black, channel black and thermal black. Examples of such products commercially available are KETCHEN BLACK EC (brand name, product of Lion Yushi Co., Ltd., Japan), SPECIAL BLACK 4 (brand name, product of Degussa Co., Ltd. Japan), CARBON BLACK MA-100 and MA-8 (brand names, products of Mitsubishi Chemical Industries Ltd., Japan), ACETYLENE BLACK (brand name, product of Denki Kagaku Kpgyo Kabushiki Kaisha, Japan), etc.

The carbon black is incorporated in the primer in an amount of 0.4 to 3.0% by weight, preferably 0.5 to 2.0% by weight. If the amount is less than 0.4% by weight, the contemplated effect will not result, whereas more than 3.0% by weight of carbon black, if used, renders the primer coating composition to viscous, so as to produce irregularties in the coating and plug up the spray nozzle, making it difficult to obtain a uniform coating and to fabricate a satisfactory roller. Furthermore, as increase in the amount of carbon black entails a reduction in release properties, so that the amount is preferably smaller insofar as triboelectrification can be inhibited to prevent offset.

The insulating layer of the pressure roller is formed from an insulating material, such as natural rubber or synthetic rubber, having rubber-like elasticity, as usually employed in producing pressure rollers.

Figure 2:
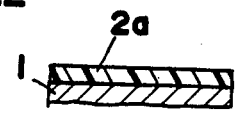
FIGS. 2 to 7 are fragmentary enlarged views illustrating a process for preparing a heating roller of the present invention.
Figure 3:
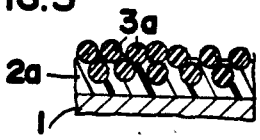
Figure 4:
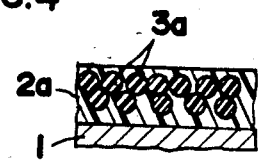
Figure 5:
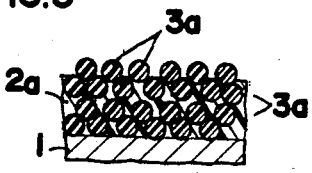

The following process is used for preparing the heating roller which comprises at least one primer layer and at least one fluorine resin layer over the primer layer, with the primer layer partly exposed at the surface of the fluorine resin layer. First, a liquid primer 2*a* having incorporated therein an electrically conductive material is sprayed over the surface of the electrically conductive core member 1 as shown in FIG. 2. Next, as shown in FIG. 3, a finely divided fluorine resin 3*a* is applied to the surface of the primer coating 2*a* by electrostatic powder coating before the primer 2*a* dries. The resulting coating is further similarly coated with the primer 2*a* and then with the fluorine resin 3*a* as seen in FIGS. 4 and 5. The primer coatings 2*a* and the fluorine resins coatings 3*a* are thereafter baked in an oven to obtain primer layers 2 and fluorine resin layers 3 in the form of a laminate as shown in FIG. 6.

Figure 6:
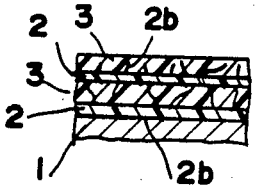

In the baking step, the finely divided fluorine resin 3*a* is baked into layers 3 while permitting the primer 2*a* to penetrate into the layers 3 among the particles of the resin 3*a*, with the result that penetrating portions 2*b* partially extending from the primer layers 2 are formed in the fluorine resin layers 3 and are very well dispersed therein as shown in FIG. 6. In the fluorine resin layer 3 sandwiched beween the two primer layers 2, the penerating portions 2*b* from the primer layers 2 are continuous. In the fluorine resin surface layer 3, almost all the penetrating portions 2*b* from the primer layer 2 therebeneath are formed without reaching the surface of the fluorine resin layer 3.

Figure 7:
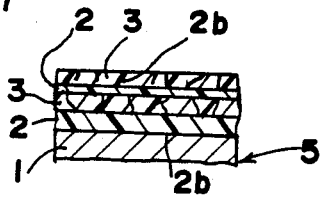

Accordingly the surface of the fluorine resin surface layer 3 is ground to expose the penetrating portions 2*b* from the underlying primer layer 2 at the surface of the fluorine resin surface layer 3 as seen in FIG. 7.

Figure 8:
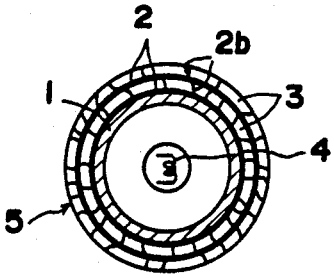
FIG. 8 is a cross sectional view showing the heating roller prepared according to the present invention.

The above process gives the heating roller 5 of FIG. 8 which comprises primer layers 2 formed of a primer 2*a* incorporating an electrically conductive material therein and fluorine resin layers 3. The layers 2 and the layers 3 are formed alternately one over the other so as to form the surface of the heating roller 5 by one of the fluorine resin layers 3, with the penetrating portions 2*b* of the primer layer 2 exposed at the surface of the fluorine resin surface layer 3 as distributed over the surface. Since the heating roller 5 has the fluorine resin layer 3 over its surface, the fusion or thermal adhesion of toner can be prevented. The surface portions of the fluorine resin surface layer 3 are electrically connected to the electrically conductive core member 1 by the primer layers 2 of primer 2*a* incorporating the conductive material and by the penetrating portions 2*b* thereof and are grounded via the core member 1, so that the triboelectrification of the fluorine surface layer 3 due to the frictional contact thereof with the pressure roller 8 or copy paper P can be greatly inhibited irrespective of the polarity. Thus copies can be produced without offset at all times from the initial stage of operation of the fixing device irrespective of whether the toner is charge positively or negatively.

EXAMPLE 1

A liquid primer (MP902BN, product of Mitsui Phlorochemical Co., Japan) having a solids content of 19% by weight and containing carbon balck (KETCHEN BLACK EC, product of Lion Yushi Co., Ltd., Japan) as an electrically conductive material was sprayed onto an aluminum roller serving as the electrically conductive core member 1. Next, finely divided PFA resin was applied to the primer coating 2*a* by electrostatic powder coating before the coating dried. The resulting coating was coated similarly with primer 2*a* by spraying and then with finely divided PFA resin electrostatically. The overall coating was thereafter baked at about 400° C. in an oven. The outer peripheral surface of the PFA resin surface layer was subsequently ground to expose the penetrating portions from the underlying primer layer at the surface of the PFA resin surface layer, whereby a heating roller was prepared.

Table 1 shows the amount of carbon black used (per 100 parts by weight of the primer containing 19% by weight of solids), the thicknesses of the primer layers 2 and the PFA resin layers 3 and the amount of grinding.

The surface of another aluminum roller was covered with a commercial silicone rubber to prepare a pressure roller. A heat roller fixing device of the type shown in FIG. 1 was fabricated with use of the rollers.

TABLE 1

| Example | Amount of carbon in primer (part by wt.) | Thickness of layer (μ) 1st layer (primer) | 2nd layer (PFA resin) | 3rd layer (primer) | 4th layer (PFA resin) | Amount of grinding |
|---|---|---|---|---|---|---|
| 1 | 1.0 | 5 | 15 | 5 | 15 | 5 |
| 2 | 0.5 | 5 | 15 | 5 | 15 | 5 |
| | 1.5 | " | " | " | " | " |
| | 2.0 | " | " | " | " | " |
| 3 | 1.0 | 5 | 5 | 5 | — | 5 |
| | " | " | 15 | " | — | " |
| | " | " | 30 | " | — | " |
| 4 | 1.0 | 5 | 15 | 5 | 23 | 5 |
| | " | " | " | " | 30 | " |
| 5 | 1.5 | 15 | 35 | — | — | 5 |

The fact that the above device fulfills the object of the invention will be described with reference to the following measurements and comparative example.

A. Determination of charging characteristics of heating roller

Figure 10:
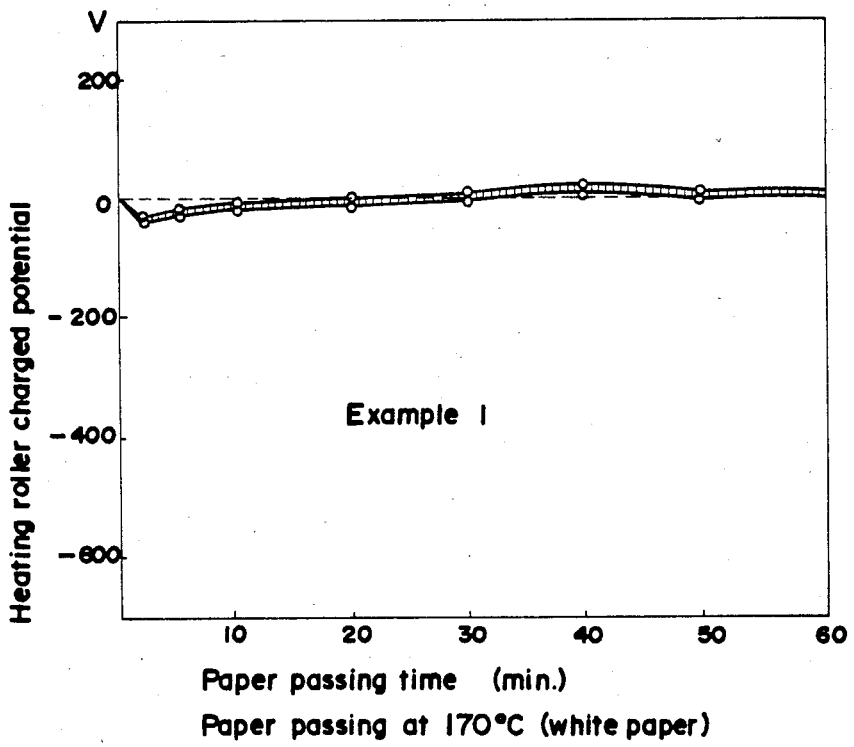

The charging characteristics of the heating roller were determined during a copying operation at a temperature of 170° C. which was selected from the fixing temperature range of 140° to 180° C. for various kinds of toners. For this purpose, sheets of copy paper of A4 size bearing no toner images were passed between the two rollers at a speed of 11 cm/sec., and the maximum and minimum surface potential on the circumference of the heating roller were measured by a vibrating-type surface potentiometer. FIG. 10 shows the results.

B. Determination of offset properties

Figure 9:
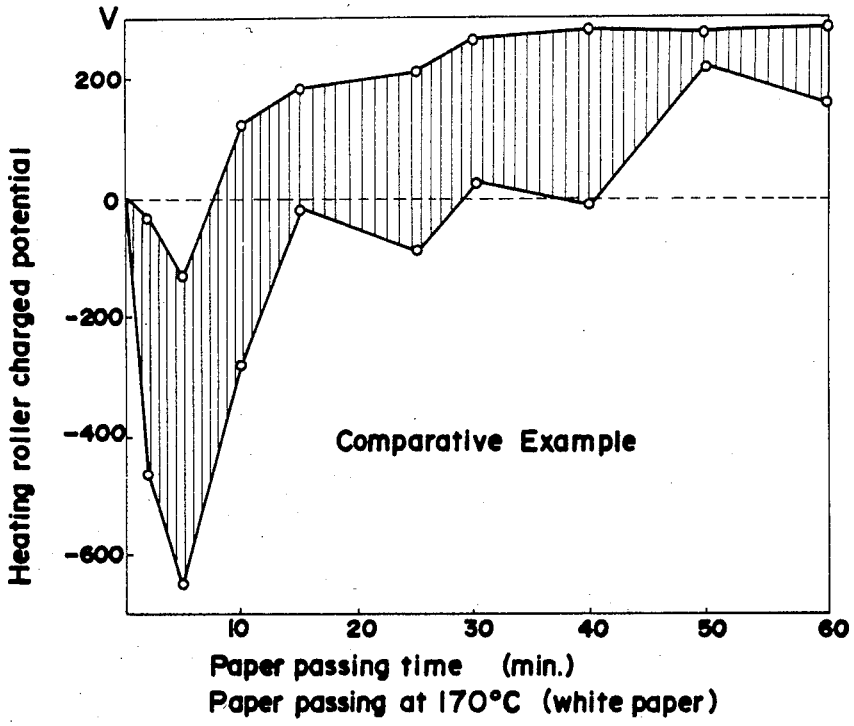
FIGS. 9 to 19 are diagrams showing the charging characteristics of the heating rollers prepared in a comparative example and examples of the present invention.

FIG. 9, showing the charging characteristics of the conventional heating roller to be given as the comparative example, indicates that the roller is most susceptible to the offset of positively charged toner during the period of 2 to 5 minutes after the start of passage of copy paper, and to the offset of negatively charged toner 60 minutes after the start of passage. The heating rollers prepared in the examples to follow were tested during the above period and at the above point of time at temperatures of about 120 to about 220° C. for marked offset, slight offset and non-offset to determine the temperature ranges permitting these offset phenomena, using sheets of copy paper bearing a positively charged toner image (toner: composed chiefly of styreneacrylic resin, having a mean particle size of 14μ and charged to 10 to 12 μc/g) formed electrophotography, and sheets of copy paper bearing a negatively charged toner image (toner: composed chiefly of styrene-acrylic resin, having a mean particle size of 14μ and charged to 10 to 12 μc/g) similarly formed. The results are shown in FIG. 20, in which the area hatched by oblique lines reqpresents marked offset, the area marked with horizontal lines indicates slight offset, and the blank area shows non-offset.

COMPARATIVE EXAMPLE

A heat roller fixing device of the type shown in FIG. 1 was fabricated in the same manner as in Example 1 except that a heating roller of the conventional type was prepared by forming a primer layer 2 of 6μ in thickness containing no conductive material over an electrically conductive core member 1, and further forming a PFA resin layer 3 of 30 to 40μ in thickness over the primer layer 2. FIG. 9 shows the charging characteristics of the heating roller. The roller was negatively charged to a maximum of −650 V after about 5 minutes passage of paper and was positively charged to a maximum of +280 V after the reversion of polarity. During the period of 2 to 5 minutes and 60 minutes after the start of passage of paper, marked offset occurred over the entire temperature range as shown in FIG. 20.

In contrast, the maximum charge potentials on the heating roller of Example 1 were inhibited to −45 V for negative polarity and +20 for positive polarity. Although there was no non-offset temperature range in the comparative example, no offset was observed in Example 1 over the temperature range of about 130° to about 220° C. during the 2–5 minute period, and over the range of about 140° to about 220° C. at the 60-minute point of time as represented by blanks in FIG. 20. In addition, there is a slight offset temperature range between the non-offset temperature range and marked offset temperature range.

The heating roller of Example 1 was further tested for long-term durability with use of 120,000 copy paper sheets. No changes were found in the anti-offset properties, while the roller was found less susceptible to defacement than the roller of the comparative example at the portions thereof in contact with the thermistor and the separating pawl. Presumably this indicates that the penetrating portions extending from the primer layer and exposed at the surface of the heating roller give improved strength to the PFA resin layer forming the surface of the heating roller.

EXAMPLE 2

Figure 11:
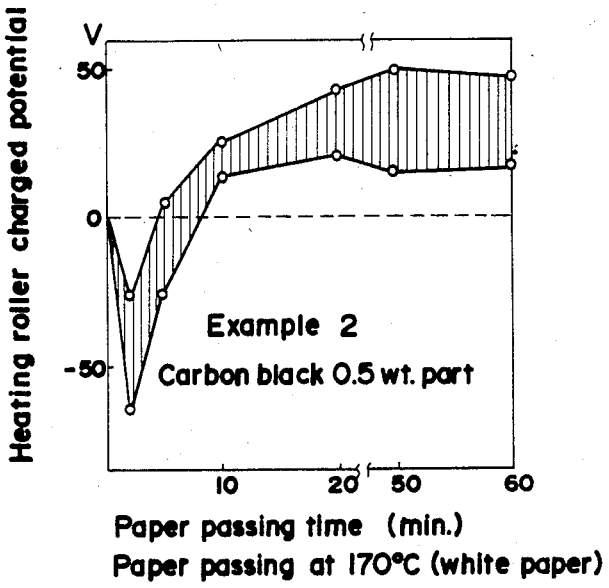

A heat roller fixing device of the type shown in FIG. 1 was fabricated in the same manner as in Example 1 except that the heating roller was prepared with use of 0.5, 1.5 or 2.0 parts by weight of carbon black as listed in Table 1 to demonstrate the dependence of the antistatic properties of the roller on the amount of carbon added (i.e. carbon content). Generally the prevention of charging is dependent on the carbon content; the smaller the carbon content, the lower is the effect to prevent charging. However, with an excess of carbon present, the surface of the heating roller exhibits reduced release properties and consequently becomes more prone to offset. When the carbon content in Example 1 is varied to 0.5, 1.5 and 2.0 parts by weight, the heating roller exhibits the charging characteristics shown in FIGS. 11, 12 and 13, respectively. These drawings and Example 1 wherein the carbon content is 1.0 part by weight reveal that the effect to prevent charging of both positive and negative polarities increases with an increase in the carbon content. Accordingly when the carbon content is 0.5 part by weight which is less than in Example 1, the maximum charge potentials are −65 V for negative polarity and +47 V for positive polarity, thus exhibiting a tendency toward slightly greater chargeability than in Example 1. Nevertheless, the result is exceedingly superior to that achieved in the comparative example.

As to the likelihood of offset, on the other hand, FIG. 20 shows at the carbon contents of 0.5, 1.5 and 2.0 parts by weight wide non-offsent temperature ranges which are comparable to the corresponding range of Example 1.

When tested for durability, the heat rollers were found to be as satisfactory as the roller of Example 1.

EXAMPLE 3

The thickness of the PFA resin layer as the second layer influences the connection between the penetrating portions from the first layer of primer and those from the third layer of primer and consequently governs the charging characteristics of the heating roller. To investigate the dependence of the charging characteristics on the thickness of the second layer of PFA resin, a heat roller fixing device of the type shown in FIG. 1 was fabricated in the same manner as in Example 1 except that the heating roller was prepared by forming the second layer of PFA resin in a thickness of 5μ, 15μ or 30μ, forming the second layer of primer in a thickness of 5μ and thereafter removing the 5-μ-thick primer layer by grinding as listed in Table 1.

Figure 14:
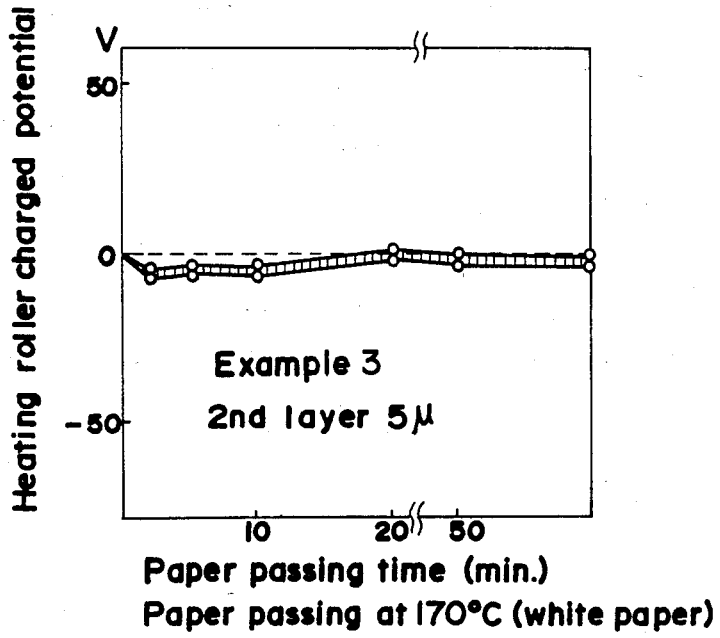
Figure 15:
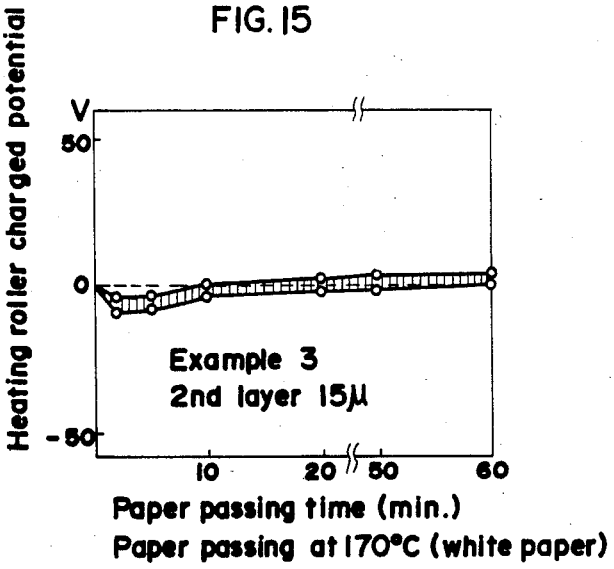
Figure 16:
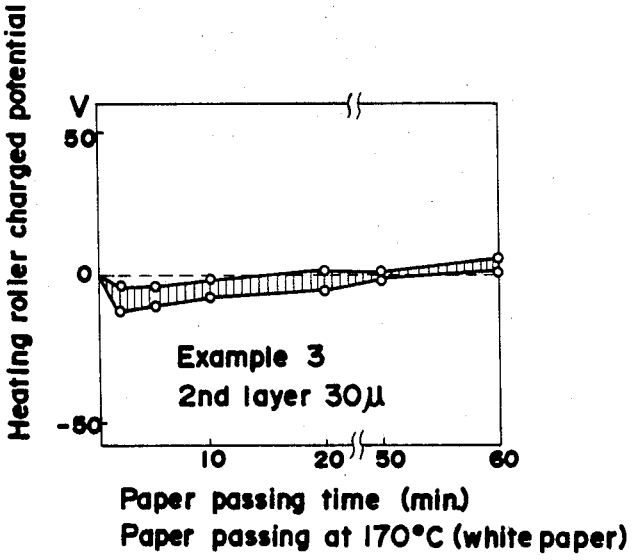

When the thickness of the PFA resin layer is 5μ, 15μ and 30μ, the heating roller exhibits the charging characteristics of FIGS. 14, 15 and 16, respectively. Although the charging preventing effect slightly decreases as the thickness is reduced, the maximum charge potentials at the largest thickness of 30μ are −12 V for negative polarity and about −5 V for positive polarity, thus showing fairly high antistatic properties. This appears to indicate that when the finely divided PFA resin of the second layer is baked, the carbon black-containing primer of the first layer and the carbon black-containing primer of the third layer sandwiching the second layer both partly penetrate into the second layer and become connected at the pentrating portions even if the second layer of PFA resin has a somewhat increased thickness.

As to the likelihood of offset at varying temperatures, FIG. 20 shows a slightly lower offset preventing effect at a high tempeature range than in the case of Examples 1 and 2. In practice, however, no problem will arise since no offset occurs over the fixing temperature range actually used.

When tested for durability, the heating rollers were found to be as satisfactory as the roller of Example 1.

EXAMPLE 4

Figure 17:
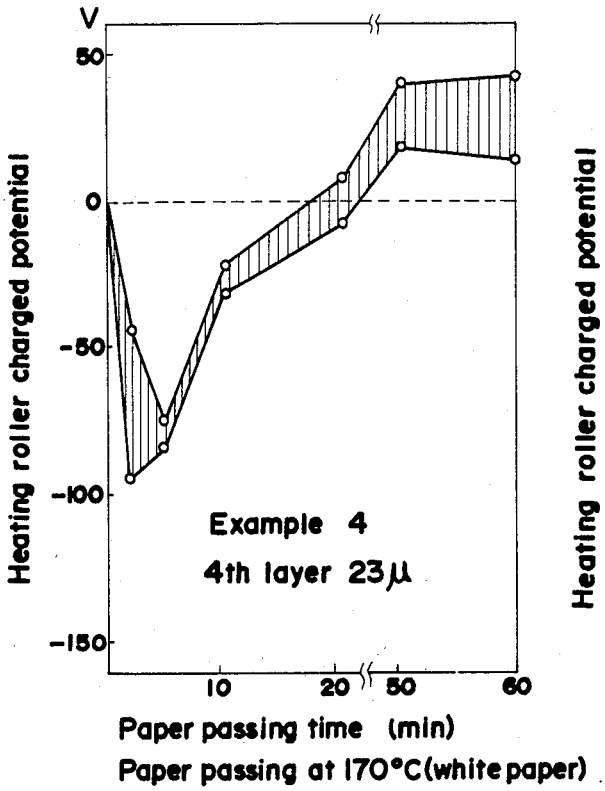

A heat roller fixing device of the type shown in FIG. 1 was fabricated in the same manner as in Example 1 except that the thickness of the fourth layer of PFA resin of the heating roller was altered as listed in Table 1 to determine the dependence of prevention of charging on the thickness of the fourth layer. When the fourth layer of PFA resin is formed in a thickness of 23μ or 30μ and then removed by a thickness of 5μ by grinding, the heating roller exhibits the charging characteristics shown in FIG. 17 or 18. These drawings and Example 1 wherein the fourth PFA resin layer is 15μ in thickness indicate that the effect to prevent negative charging decreases as the thickness of the fourth layer increases, and that the rate of the decrease is greater than when the thickness of the second layer of PFA resin is increased in Example 3. Presumably this is attributable to the fact that the carbon black-containing primer of the third layer alone penetrates into the fourth PFA resin layer.

As to the offset of positively charged toner at varying temperatures, the present example and Example 1 reveal that as the thickness of the fourth layer of PFA resin increases, the marked offset temperature range, as well as the slight offset temperature range, increases to reduce the non-offset temperature range.

These results indicate that the prevention of charging of both positive and negative polarities is dependent largely on the thickness of the fourth PFA resin layer. That is with the standard structure wherein the first layer of primer is 5-μ thick, the second layer of PFA resin is 15-μ thick and the third layer of primer is 5-μ thick, the fourth PFA resin layer should preferably be about 15 to 20μ in thickness.

When tested for durability, the heating rollers were found to be as satisfactory as the roller of Example 1.

EXAMPLE 5

A heat roller fixing device of the type shown in FIG. 1 was fabricated in the same manner as in Example 1 with the exception of using 1.5 parts by weight of carbon black and forming the first layer of primer in a thickness of 15μ and the second layer of PFA resin in a thickness of 35μ, without forming the third layer of primer and the fourth layer of PFA resin as shown in Table 1.

When the heating roller is to be fabricated in the form of a two-layer structure without forming the third layer of primer, it is generally necessary to give an increased thickness of 30 to 40μ to the second layer of PFA resin. The present example substantiates the dependence of the prevention of charging on the thickness of the first primer layer in this case.

Figure 12:
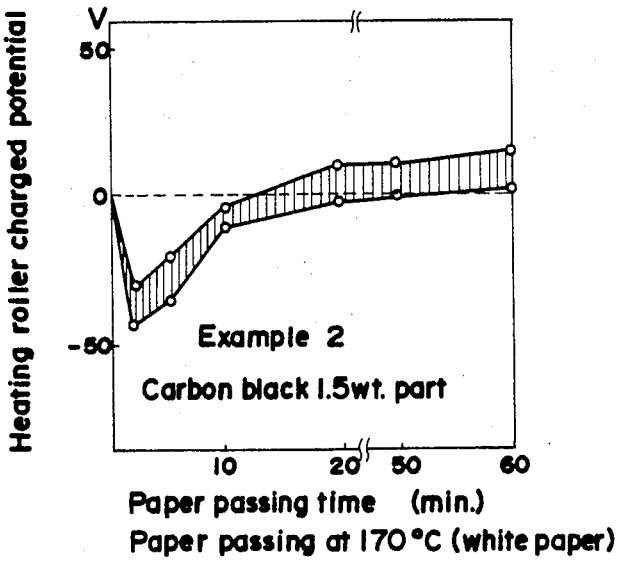
Figure 13:
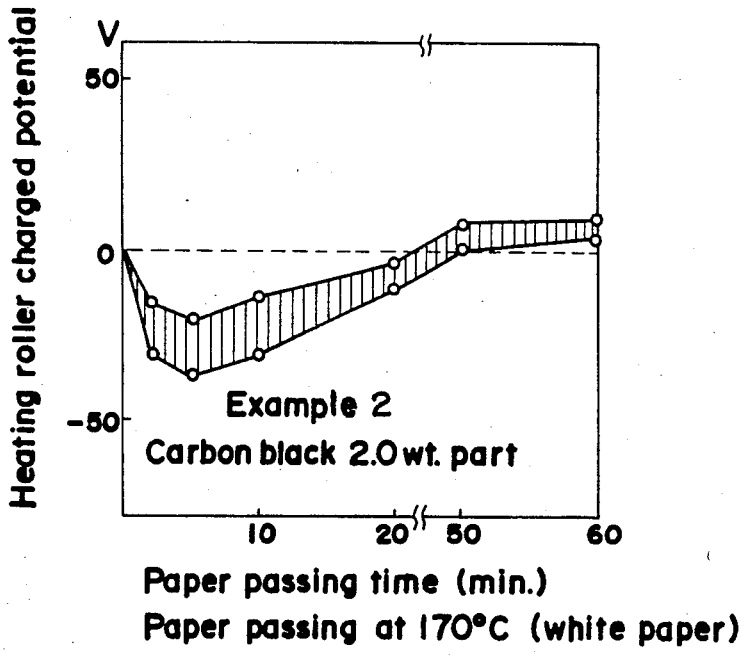
Figure 18:
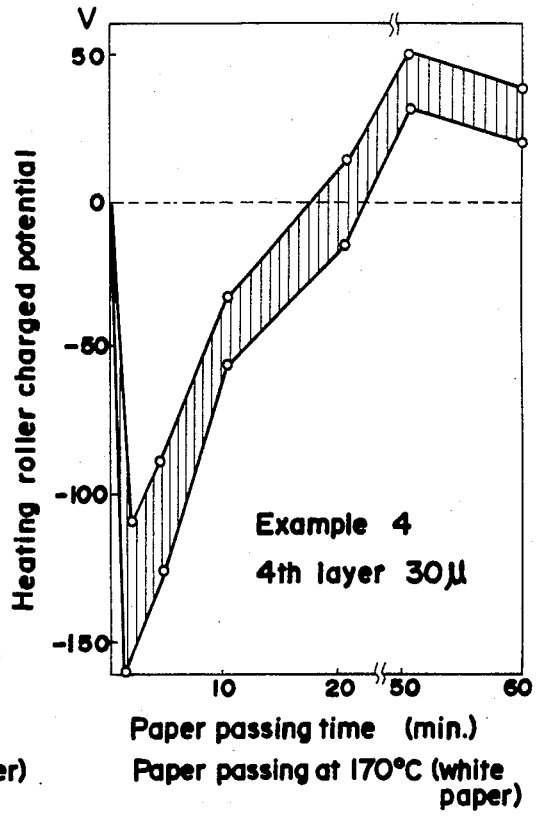
Figure 19:
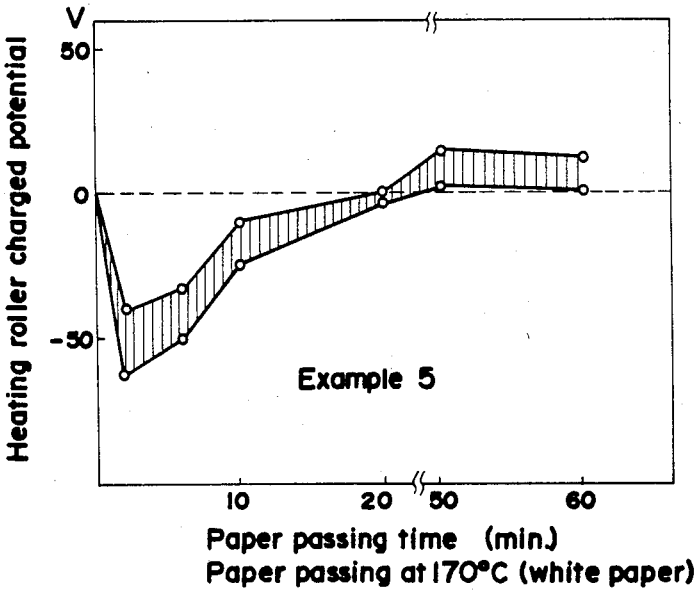

With reference to FIG. 19 showing the charging characteristics of the heating roller, the effect to prevent negative charging only is slightly lower than the heating roller of Example 2 shown in FIG. 12 and containing 1.5 parts by weight of carbon black but does not involve the phenomenon observed with the roller of Example 4 wherein the fourth layer of PFA resin is 30μ in thickness (FIG. 18). This appears attributable to the increased thickness, i.e., 15μ, of the first primer layer which accelerates the penetration of the primer into the second PFA resin layer although the second layer is as thick as 35μ.

As to the occurrence of offset at varying temperatures, FIG. 20 reveals a wide non-offset temperature range which is comparable to those determined for Examples 1 and 2.

When tested for durability, the heating roller was found as satisfactory as the roller of Example 1.

While the present invention has been described above primarily with reference to heating roller of fourlayer structure, heating rollers of three-layer structure wherein the third layers is removed by grinding fully achieve the object of inhibiting positive and negative charging to prevent offset as apparent from Example 3. Even in the case of those originally designed to have a two-layer structure without the third layer of primer, in view of the relation of the depth of scratches or defacement due to the contact of the separating pawl or thermistor to the thickness and strength (hardness) of the PFA resin layer, similar effects can be obtained by increasing the thickness of the first primer layer as demonstrated by Example 5. Additionally, when an increased thickness is given to the third layer of primer as in Example 4, the heating roller becomes usable even if the fourth layer of PFA resin has a thickness of 30μ.

What is claimed is:

1. A heat roller fixing device which comprises a first roller constituted by a fluorine resin layer laminated on a first core member, which is electrically conductive and electrically grounded, through a primer layer and positioned to contact with a surface of copy paper having a charged toner image to be fixed thereon, and a second roller constituted by an elastic material layer laminated on a second core member, positioned to contact with a back surface of the copy paper and held in contact under pressure with said first roller, wherein said first roller is produced by a process comprising the steps of:

(i) coating primer having incorporated therein an electrically conductive material over the surface of an electrically conductive first core member, to form a primer layer thereon, (ii) applying finely divided fluorine resin powder to the coated surface of said first core member, to form a fluorine resin layer on said primer layer, (iii) baking said primer and resin powder on the surface of said first core member, to form penetrating portions of said primer partially extending from said primer layer into said fluorine resin layer, and (iv) scraping a portion of said primer and said fluorine resin baked on the surface of said first core member, to expose said penetrating portions at the surface of said fluorine resin layer.

2. A heat roller fixing device as claimed in claim 1, wherein said elastic material laminated on the second core member is insulating.

3. A heat roller fixing device as claimed in claim 1, further comprising heating means for heating said first roller.

4. A heat roller fixing device as claimed in claim 3, wherein said heating means is incorporated in said first roller.

5. A heat roller fixing device as claimed in claim 1, wherein said electrically conductive material incorporated in said primer is carbon black.

6. A heat roller fixing device as claimed in claim 5, wherein the amount of the carbon black is 0.4 to 3.0% by weight.

7. A heat roller fixing device as claimed in claim 1, wherein the fluorine resin powder is polytetrafluoro ethylene perfluoro alkoxy ethylene copolymer resin powder.

8. A heat roller fixing device as claimed in claim 1, wherein steps (i) and (ii) are sequentially repeated before said step (iii).

* * * * *